US008448300B2

(12) United States Patent
Imaschewski et al.

(10) Patent No.: US 8,448,300 B2
(45) Date of Patent: May 28, 2013

(54) AUXILIARY HANDLE

(75) Inventors: Jens Imaschewski, Munich (DE); Quirin Wahle, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 254 days.

(21) Appl. No.: 12/957,518

(22) Filed: Dec. 1, 2010

(65) Prior Publication Data

US 2011/0131766 A1 Jun. 9, 2011

(30) Foreign Application Priority Data

Dec. 9, 2009 (DE) ..... 10 2009 047 705

(51) Int. Cl.
*A45C 13/26* (2006.01)

(52) U.S. Cl.
USPC ..... 16/426; 408/124; 408/241 G

(58) Field of Classification Search
USPC ..... 16/426, 422, 436, 429; 408/124, 408/241 R, 241 G; 173/161, 162.1, 162.2
See application file for complete search history.

(56) References Cited

U.S. PATENT DOCUMENTS

| | | | | | |
|---|---|---|---|---|---|
| 2,087,666 | A * | 7/1937 | Halt | 33/812 |
| 2,130,782 | A * | 9/1938 | Willoughby | 297/367 R |
| 2,803,980 | A * | 8/1957 | Vogel | 81/62 |
| 4,256,422 | A * | 3/1981 | Theissig et al. | 408/241 S |
| 4,354,779 | A * | 10/1982 | Vaughan | 408/241 S |
| 4,368,556 | A * | 1/1983 | Wanner et al. | 16/436 |
| 7,922,719 | B2 * | 4/2011 | Ralph et al. | 606/79 |
| 2004/0163214 | A1 * | 8/2004 | Cheng | 16/426 |

FOREIGN PATENT DOCUMENTS

| | | | |
|---|---|---|---|
| DE | 83 18 425 | | 10/1983 |
| DE | 3434071 | A1 * | 3/1986 |
| EP | 1336446 | | 8/2003 |
| GB | 2288757 | A * | 11/1995 |
| WO | WO 8800870 | A1 * | 2/1988 |

* cited by examiner

*Primary Examiner* — Chuck Y. Mah
(74) *Attorney, Agent, or Firm* — Leydig, Voit & Mayer, Ltd.

(57) ABSTRACT

An auxiliary handle for a hand-held power tool has a handle piece, a fixation means for fixing the auxiliary handle to the hand-held power tool, a rod with at least one set of teeth, and a guide in which the rod is seated longitudinally movably. A locking mechanism has a pawl, a pivot axis about which the pawl can be rotated between a locking position and a release position, and at least one locking tooth on the pawl that engages in a locked position with the guide, and is pivoted out of the guide in a release position. A spring element initially tensions the pawl into the locking position. A distance of the spring element from the pivot axis is less than a distance of the locking tooth from the pivot axis.

12 Claims, 4 Drawing Sheets

AUXILIARY HANDLE

BACKGROUND OF THE INVENTION

The present invention relates to an auxiliary handle. An auxiliary handle for a hand-held drilling machine is known from EP 1 336 446 B1.

BRIEF SUMMARY OF THE INVENTION

The auxiliary handle according to an embodiment of the invention can be removed from the hand-held power tool. A death stop to indicate to the user that a desired drilling depth has been reached is integrated into the auxiliary handle.

The auxiliary handle for a hand-held power according to the invention has a handle piece, a fixation means for fixing the auxiliary handle to the hand-held power tool, a rod with at least one set of teeth, and a guide in which the rod is seated longitudinally movably. A locking mechanism has a pawl, a pivot axis about which the pawl can be rotated between a locking position and a release position, and at least one locking tooth on the pawl that engages in a locked position with the set of teeth, and is pivoted out of the guide in a release position. A spring element initially tensions the pawl into the locking position. A distance of the spring element from the pivot axis is less than a distance of the locking tooth from the pivot axis. The arrangement of the spring element between the guide or the locking tooth and the pivot axis allows a particularly compact structure.

One configuration provides that the locking tooth is oriented perpendicular to a connection line of the locking tooth to the pivot axis.

One configuration provides that the rod has a polygonal profile and a set of teeth on at least one side face. If the profile has at least one of the symmetry properties from the group including rotational symmetries about an axis of the rod and mirror symmetries about planes, an arrangement of the set of teeth has at least the symmetry properties of the profile. A guide for the rod has an opening with the shape of the polygonal profile of the rod. A locking mechanism engages with the set of teeth. The profile is determined by a projection of the rod onto a surface perpendicular to the axis of the rod. The profile thus corresponds to a minimum opening through which the rod can be pushed. The guide is designed with the opening corresponding to precisely the minimum opening. The opening can be slightly larger, just enough to allow sliding of the rod in the opening. The rod can be pushed into the opening only in such a manner that the set of teeth and the multiple sets of teeth point in the correct direction for the locking mechanism. The profile or the rod has an n-fold rotational symmetry if it coincides with itself when it is rotated by an angle of 360/n about the axis of the rod.

One configuration provides that the profile is hexagonal.

One configuration provides that the rod has a set of teeth on two opposite side faces.

One configuration provides that the rotational symmetry of the profile is limited to a two-fold rotational symmetry.

One configuration provides that the profile is hexagonal, that sets of teeth are provided on two opposing side faces and four other side faces are smooth, that the profile is limited to a two-fold rotational symmetry and that a first distance of two opposing side faces is greater than a second distance of two opposing other side faces.

BRIEF DESCRIPTION OF THE SEVERAL VIEWS OF THE DRAWINGS

The description below explains the invention with reference to exemplary embodiments and figures. In the figures.

Identical or identically functioning elements are indicated in the figures by identical reference numbers, unless otherwise stated.

DETAILED DESCRIPTION OF THE INVENTION

Figure 1:
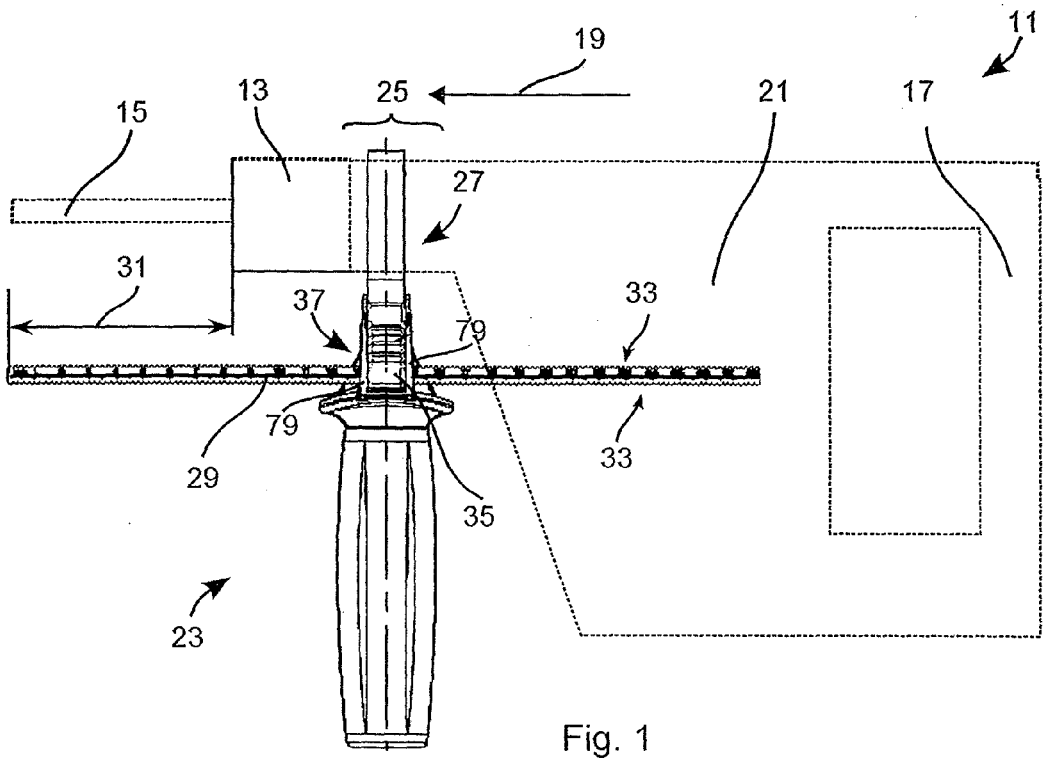
FIG. 1 shows an auxiliary handle on an electric hand-held tool.

FIG. 1 shows a drilling machine 11 or a hammer drill as an example of a hand-held power tool. The drilling machine 11 has a tool holder 13 into which a tool 15, a drill bit for example, can be inserted.

A user can guide the drilling machine 11 in the working direction 19 by means of a main handle 17. The main handle 17 is non-detachably connected to a housing 21 of the drilling machine 11. The user can affix an additional auxiliary handle 23 to the housing 21 if he would like to guide the drilling machine 11 with two hands, and can remove the auxiliary handle 23 if he has no use for it. A fixation area 25 matched to the auxiliary handle 23 is provided on the housing 21 for this purpose. In the illustrated example, the fixation area 25 is provided adjacent to the tool holder 13, and is formed, for example, by a cylindrical contour of the housing 21. The auxiliary handle 23 has an annular fixation means 27 that surrounds the fixation area 25 and is clamped to it.

An adjustable depth stop is integrated into the auxiliary handle 23. The depth stop is based on a rod 29 that projects in the working direction 19 by a distance 31 past the tool holder 13. The rod 29 is provided with a set of teeth 33, with which a locking mechanism 35 of a holder 37 is engaged in order to secure the rod 29 against movement contrary to the working direction 19. Once the rod 29 contacts the workpiece, the auxiliary handle 23 together with the drilling machine 11 cannot be moved any closer to the workpiece. The user can adjust the distance 31 by which the rod 29 projects past the holder 39 by loosening a locking mechanism 35 and securing the rod 29 in a different position.

Figure 2:
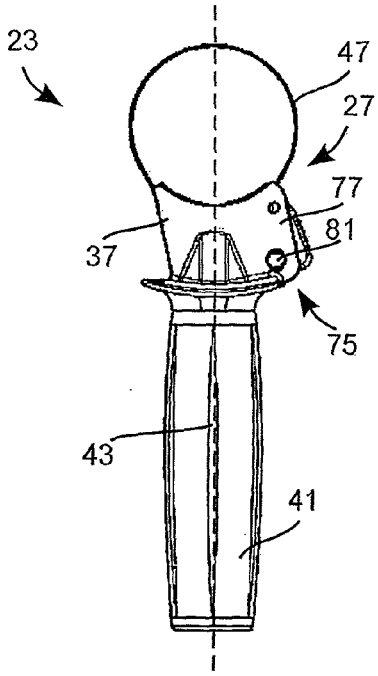
FIG. 2 shows the auxiliary handle in a front view.
Figure 3:
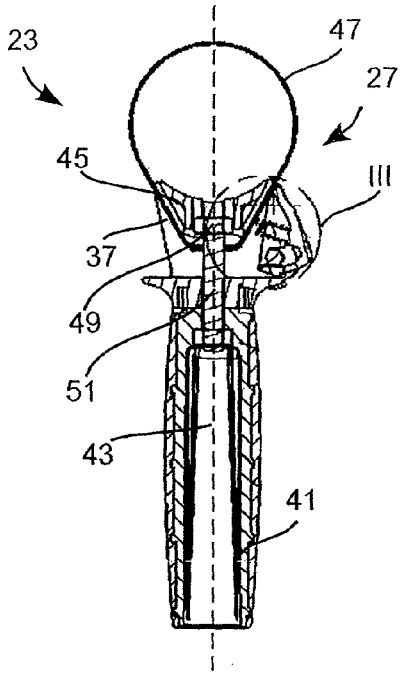
FIG. 3 shows the auxiliary handle in a longitudinal section.
Figure 4:
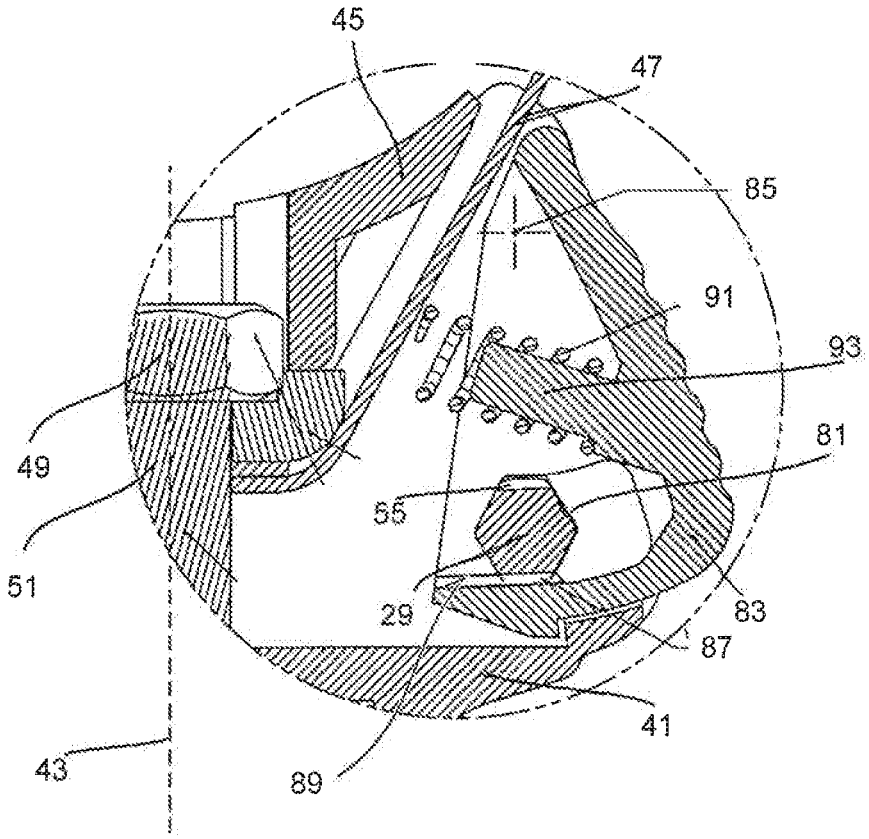
FIG. 4 shows an enlarged cutout from FIG. 3.

The exemplary auxiliary handle 23 is shown in a front view in FIG. 2, in a longitudinal section in FIG. 3 and in an enlarged cutout III thereof in FIG. 4. The auxiliary handle 23 contains a handle piece 41, the fixation means 27 and the holder 37. The holder 37 is arranged above the handle piece 41, i.e., between the handle piece 41 and the fixation means 27, and laterally offset relative to an axis 43 of the auxiliary handle 23.

The illustrated fixation means 27 has a support rest 45 and a tensioning belt 47. The tensioning belt 47, e.g., a metal belt made of spring steel, is bent into a loop. The loop outside the support rest 45 is sufficiently large to enclose the fixation area 25 of the drilling machine 11. A tensioning anchor 49 engages with the tensioning belt 47. By rotating the handle piece 41, the tensioning anchor 49 is drawn by means of a threaded spindle 51 in the direction towards the handle piece 41. The loop of the tensioning belt 47 is shortened, whereby the fixation area 25 is pressed against the support rest 45.

Alternatively to the illustrated variant of the fixation means 27, the tensioning belt can be tightened by means of a spreading element. Alternatively, a clamp is used as the fixation means. Another embodiment provides a screw thread on the handle piece 41 that can be screwed into a matching nut thread on the drilling machine 11.

Figure 5:
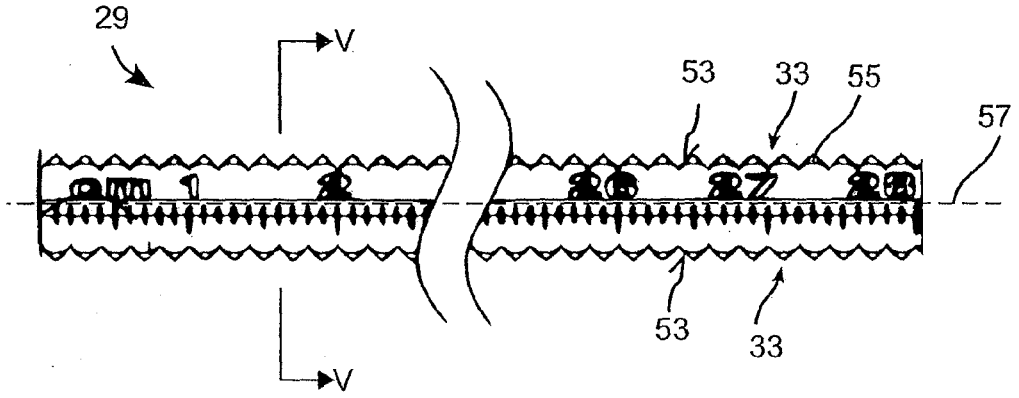
FIG. 5 shows a rod for a depth stop in a side view.
Figure 6:
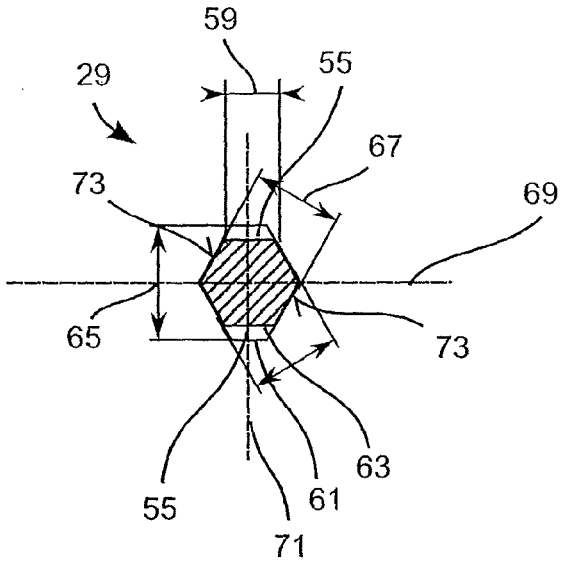
FIG. 6 shows a cross section through the rod of FIG. 5.

An example of a rod 29 is shown in FIG. 5 in a side view and in FIG. 6 in a section along the plane V-V. The rod 29 has a hexagonal profile. The rod is furnished with two sets of teeth 33 on two opposing side faces 53. Teeth 55 of the set of teeth 33 are oriented perpendicular to the axis 57 of the rod 29. The two sets of teeth 33 are constructed identically and aligned with one another. Each tooth 55 of the first set of teeth 33, along with a tooth 55 of the other set of teeth 33, lies in a plane perpendicular to the axis 57 of the rod.

FIG. 6 shows a cross section between two teeth 55 of the set of teeth 33. The teeth 55 of the set of teeth 33 preferably occupy the entire width 59 of the sides 53. Given the hexagonal profile, a cross section of the teeth 55 is trapezoidal. A crest 61 of the teeth 55 is narrower than a root 63 of the teeth 55. A first distance 65 between the opposite crests 61 of two teeth 55 is different from a second distance 67 of two other parallel side faces without teeth 33. The first distance 65 is preferably greater than the second distance 67. In this way a mechanically more stable structure of the rod 29 can be achieved.

The teeth 55 of the opposing set of teeth 33 of the rod 29 can lie in one plane. In another embodiment the teeth 55 are in mutually offset planes, i.e., a tooth 55 of a set of teeth 33 can coincide with a trough between two teeth 55 of the opposing set of teeth 33. The two sets of teeth 33 are not symmetric with respect to their position along an axis 57 of the rod 29 but rather with respect to the angular arrangement about the shaft 57.

With the sets of teeth 33 arranged symmetrically with respect to the axis 57 of the rod 29, the rod 29 is mirror-symmetric about a plane 69 parallel to the set of teeth 33, and mirror-symmetric about a plane 71 perpendicular to the sets of teeth 33, and has a twofold rotational symmetry about the axis 57, i.e., the rod 29 coincides with itself in case of a rotation by 180° (360° divided by two) about the axis 57. The rod 29 does not have a higher rotational symmetry, in particular a sixfold symmetry, because the other side faces 73 are formed flat without teeth.

The profile of the rod 29 has at most mirror symmetries and rotational symmetries as symmetry properties that the body of the rod 29 also has, in particular, the profile is not sixfold rotationally symmetric. The symmetry of the body is defined by the arrangement of the sets of teeth 33, among other things. Profile is to be understood as the outline of a profile that results from a side view or projection onto a surface oriented perpendicular to the axis 57 of the rod 29. In the example of FIG. 5, the profile corresponds to the cross section in a plane through the teeth 55. The body of the rod 29 has the largest dimensions in this plane. A cross section in other planes, in particular in a plane V-V between the teeth (FIG. 6) has a smaller surface area, which lies inside the profile.

The hexagonal rod concentrates a high mechanical stability in itself despite the weakening accompanying the sets of teeth 33. At the same time the profile can be produced deviating markedly from a hexagonal symmetry, in order to adapt the symmetry to the number of sets of teeth 33. The rod 29 preferably has two sets of teeth 33 on opposing sides as shown, which allow the user to find more quickly an orientation with which the rod 29 can be inserted into the holder 37. Alternatively, the hexagonal rod 29 can also have three sets of teeth. The crests of the teeth are preferably narrower than the side walls with the flat surfaces, in order to allow a threefold but not a sixfold rotational symmetry. Alternative rods 29 can also have a rectangular or octagonal profile.

The holder 37 of the depth stop contains a guide 75 for the rod 29. The holder 37 has a housing 77 with two opposing walls 79. Along an axis parallel to the working direction 19, a respective opening 81 is provided in the walls 79. The openings 81 are precisely fit to the profile of the rod 29 in such a manner that it can't be pushed through these openings 81 and is laterally guided. With a rod 29 inserted into the guide 75, its side faces contact the edges of the openings 81, at least in part.

The locking mechanism 35 of the holder 37 is based on a pawl 83. The pawl 83 is pivotable about a pivot axis 85 that is parallel to the rod 29. The pawl 83 has one or more locking teeth 87. The locking teeth 87 are oriented parallel to the teeth 55 of the rod 29 and perpendicular to the pivot axis 85. The radial distance of the locking tooth 87 away from the pivot axis 85 is selected as a function of the distance of the guide 75 from the pivot axis 85 and the provided orientation of the rod 29 in the guide 75, in such a manner that the locking tooth 87 can be pivoted to a locking position engaged between the teeth 55. FIG. 4 shows a locking tooth 87 which engages in a set of teeth 33 of the rod 29 that are facing away as viewed from the pivot axis 85. The rod 29 is thus situated between the pivot axis 85 and the locking tooth 87. An edge 89 of the locking tooth 87 is substantially perpendicular to a connecting line to the pivot axis 85. The arrangement of the locking tooth 87 at an end of the pawl 83 remote from the pivot axis 85 allows a compact construction. A pivot angle for releasing the locking can be kept small. Nevertheless, the rod 29 cannot pivot the pawl 83 on its own, since the orientation of the locking tooth 87 is perpendicular to the connecting line to the pivot axis 85.

A spring element 91 that initially tensions the pawl 83 into the locking position acts on the pawl 83. To release the locking mechanism, the user presses laterally onto the pawl 83 and pivots it against the spring force of the spring element 91. The spring element 91 is arranged between the pivot axis 85 and the locking tooth 87. A distance of the spring element 91 from the pivot axis 85 is less than a distance of the locking tooth 87 from the pivot axis 85. The spring element 91 can be a spiral spring as shown. A spiral spring is placed on a pin 93 on the pawl 83. Alternatively, a leaf spring or some other elastic body can be used as a spring element.

In another embodiment, the locking tooth 87 engages in a set of teeth 33 of the rod 29 facing towards the pivot axis 85. In another embodiment, the edge 89 of the locking tooth 87 is parallel to a connecting line to the pivot axis 85. The locking tooth 87 has substantially the same radial distance away from the pivot axis 85 as the guide 75. Thereby the necessary pivot angle for releasing the locking can be further reduced. The spring element 91 is designed to be stronger than in the previous embodiment, in order to prevent the pawl 83 from being pushed away by the rod 29

The pawl 83 can exert a clamping force onto the rod 29 in order to prevent a displacement of the rod 29 when it is stopped. An improved locking can be achieved by means of the teeth 33. For this it is necessary that the user introduces the rod 29 with an orientation such that one of its sets of teeth 33 can come into engagement with the locking tooth 87. The limitation of the symmetry of the profile of the rod 29 and the guide 75 to the symmetry with respect to the arrangement of the sets of teeth 33 prevents the user from being able to insert the rod 29 incorrectly into the guides.

Figure 7:
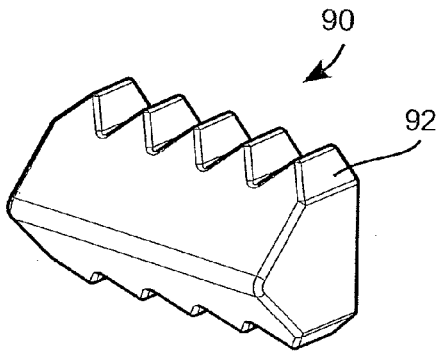
FIG. 7 shows a part of an additional rod for a depth stop.
Figure 8:
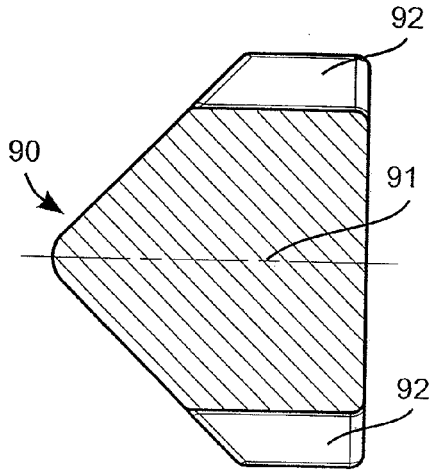
FIG. 8 shows a cross section through the rod of FIG. 7.

FIGS. 7 and 8 show another rod 90, which is shortened in length for reasons of simplified representation and is shown with only a few teeth 55. The profile of the rod 90 is pentagonal and has a mirror symmetry about a plane 91. Teeth 92 are likewise arranged mirror-symmetrically with respect to the plane 91. The opening of the holder for this rod is pentagonal corresponding to the shape of the profile.

Figure 9:
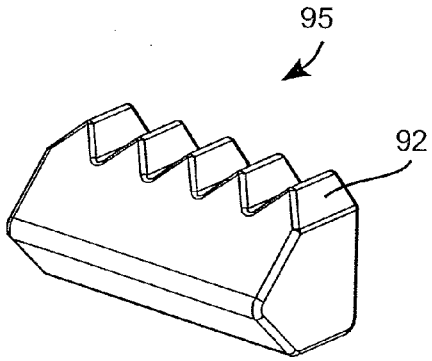
FIG. 9 shows a part of an additional rod for their depth stop.
Figure 10:
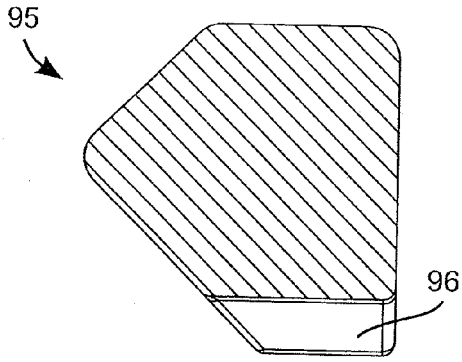
FIG. 10 shows a cross section through the rod of FIG. 9.

FIGS. 9 and 10 show another shortened rod 95. The profile of the rod 95 has no symmetry. The arrangement of the teeth 96 on only one side is likewise without symmetry.

The invention claimed is:

1. An auxiliary handle for a hand-held power tool, comprising a handle piece allowing a user to guide the hand-held power tool by placing one hand on the power tool, and another hand on the handle piece, a fixation means for fixing the auxiliary handle to the power tool, a rod with at least one set of teeth, a holder comprising a guide in which the rod is seated longitudinally movably, wherein the fixation means and the handle piece are attached the holder, a pawl comprising at least one locking tooth, a pivot axis, about which the pawl is pivotable between a locking position preventing the rod from moving longitudinally and a release position allowing the rod to move longitudinally, the at least one locking tooth that, upon the pawl pivoting about the pivot axis, engages with the at least one set of teeth in the locking position and prevents the rod from moving longitudinally, and pivots out of the guide in the release position where the at least one locking tooth disengages from said at least one set of teeth to allow the rod to move longitudinally, a spring element that initially tensions the pawl into the locking position, the spring element being arranged between the pivot axis and the locking tooth, wherein a distance of the spring element from the pivot axis is less than a distance of the locking tooth from the pivot axis, the pawl being pivotable by the user against spring force of the spring element to move the pawl from the locking position to the release position.

2. The auxiliary handle according to claim 1, wherein the rod has a polygonal profile and a set of teeth on at least one side face thereof.

3. The auxiliary handle according to claim 2, wherein the guide for the rod has an opening that is form fit to the polygonal profile of the rod.

4. The auxiliary handle according to claim 1, wherein the rod has a hexagonal profile and has a respective set of teeth on two opposing side faces thereof, and wherein a rotational symmetry of the profile is limited to a twofold rotational symmetry about an axis of the rod.

5. The auxiliary handle according to claim 1, wherein the rod has a polygonal profile, and the guide for the rod has an opening that is form fit to the polygonal profile of the rod.

6. The auxiliary handle according to claim 1, wherein the locking tooth has an edge that is oriented perpendicular to an axis of the rod.

7. The auxiliary handle of claim 1, wherein the fixation means comprises a tensioning belt.

8. The auxiliary handle according claim 7, wherein the locking tooth has an edge that is oriented perpendicular to an axis of the rod.

9. The auxiliary handle according to claim 7, wherein the rod has a polygonal profile and a set of teeth on at least one side face thereof.

10. The auxiliary handle according to claim 7, wherein the rod has a hexagonal profile and has a respective set of teeth on two opposing side faces thereof, and wherein a rotational symmetry of the profile is limited to a twofold rotational symmetry about an axis of the rod.

11. The auxiliary handle according to claim 7, wherein the rod has a polygonal profile, and the guide for the rod has an opening that is form fit to the polygonal profile of the rod.

12. The auxiliary handle according to claim 1, wherein the pawl further comprises a pin, and the spring element is arranged on the pin.

* * * * *